United States Patent [19]

O'Bar

[11] Patent Number: 4,486,980

[45] Date of Patent: Dec. 11, 1984

[54] TRACK AND LATCH ASSEMBLY FOR SLIDABLE DOOR

[75] Inventor: Edward J. O'Bar, Harrisville, R.I.

[73] Assignee: Jannel & Son Body Company, Woonsocket, R.I.

[21] Appl. No.: 572,762

[22] Filed: Jan. 20, 1983

[51] Int. Cl.[3] ..... E05D 13/04

[52] U.S. Cl. ..... 49/449; 49/213; 49/222; 49/411

[58] Field of Search ..... 49/449, 411, 410, 369, 49/213, 222

[56] References Cited

U.S. PATENT DOCUMENTS

| | | | |
|---|---|---|---|
| 1,376,350 | 4/1921 | Neumann et al. | 49/222 |
| 1,611,536 | 12/1926 | Lacy | 49/222 X |
| 3,103,713 | 9/1927 | Ahlgren | 49/449 X |
| 4,114,317 | 9/1928 | Crawley | 49/449 X |

*Primary Examiner*—Philip C. Kannan

*Attorney, Agent, or Firm*—Salter & Michaelson

[57] ABSTRACT

A track and latch assembly for a slidable door is disclosed. The track and latch assembly is operative in combination with a slidable door of the type which is slidably supported adjacent the upper end thereof from a wall so that the door is slidable along the surface of the wall for movement between open and closed positions, but so that the door is slightly outwardly pivotable about an axis adjacent the upper end thereof for movement of the lower portion of the door outwardly slightly with respect to the wall. The track and latch assembly includes a track which is mounted in fixed relation with respect to the wall adjacent the lower end of the door and a latch assembly which is mounted on the door. The latch assembly and the track cooperate for guiding and positioning the lower end of the door so that when it is in either of the open or closed positions thereof, it is in snug engagement with the wall adjacent the lower end of the door, but so that when the door is in an intermediate position, the lower portion thereof is outwardly spaced from the wall to permit the door to slide freely. Accordingly, the door is firmly held so that it is maintained substantially rattle-free when it is in either of the open or closed positions but it is nevertheless easily slidable between said positions.

9 Claims, 4 Drawing Figures

TRACK AND LATCH ASSEMBLY FOR SLIDABLE DOOR

BACKGROUND AND SUMMARY OF THE INVENTION

The instant invention relates to slidable doors and more particularly to a track and latch assembly for guiding the lower end of a slidable door during sliding movement thereof between open and closed positions, and for firmly and tightly securing the door so that it is positioned in snug engagement with an adjacent wall when the door is located in either the open or closed positions.

The use of slidable door assemblies for various applications, including the use thereof in various types of vehicles, has been known for a number of years. In most cases, slidable doors have been slidably supported adjacent the upper ends thereof from upper trackways or the like so that they are easily slidable between open and closed positions. Various types of lower guides or trackways have been used in combination with upper trackways for guiding the lower ends of doors and for positioning them in open and closed positions. However, one problem which has been experienced with many of the known slidable door assemblies has resulted from the fact that they have utilized guides and trackways which have held doors rather loosely, even when they are in the open and closed positions. This has presented a particular problem with slidable door assemblies used in vehicles where a door must always be firmly held during movement of a vehicle in order to prevent rattling. Unfortunately, however, virtually all of the slidable door assemblies of the above type heretofore available for use on vehicles, including trucks and the like, have been deficient in this respect and therefore substantial door rattling has been a continual problem with virtually all of the slidable door assemblies of this general type which have been used on vehicles.

While the problem of providing an effective slidable door assembly has been addressed on a number of occasions, the heretofore available slidable door assemblies have not adequately addressed the problem of door rattling. In this regard, disclosures relating to slidable door assemblies which represent the closest prior art to the instant invention of which the applicant is aware are found in the U.S. patents to LEHNERT, U.S. Pat. No. 86,675; KEISER et al, U.S. Pat. No. 1,092,108; LIENIZ, U.S. Pat. No. 1,414,783; GILPIN, U.S. Pat. No. 1,461,035; BUSSE, U.S. Pat. No. 2,167,707; TAYLOR, U.S. Pat. No. 3,337,995 and JOHNSON, JR., U.S. Pat. No. 3,562,956. While these references relate generally to various types of slidable door assemblies, some of which include means for securing doors in open and/or closed positions, they do not teach a slidable door assembly which includes a track and latch assembly for securing and positioning a slidable door in the manner of the track and latch assembly of the instant invention. More specifically, they do not teach a track and latch assembly which is operative for positioning the lower end of a slidable door so that it is in snug engagement with an adjacent wall when the door is in either of the open or closed positions thereof. Hence, the disclosures of the above references are believed to be of nothing more than general interest with respect to the novel track and latch assembly of the instant invention.

The track and latch assembly of the instant invention provides a unique means for securing and positioning the lower end of a slidable door so that it is in snug engagement with a wall adjacent the door when the door is in either of the open or closed positions thereof, but so that the lower end of the door is spaced outwardly from the wall when the door is located in an intermediate position between the open and closed positions thereof to permit the lower end of the door to slide freely. The track and latch assembly of the instant invention is operable in a sliding door assembly of the type wherein a door of the assembly is slidably supported adjacent the upper end thereof from a wall so that it is movable between open and closed positions, and wherein the door is at least slightly outwardly pivotable about an axis adjacent the upper end thereof for moving the lower portion of the door slightly outwardly and away from the wall. The track and latch assembly of the instant invention comprises a track which is mounted in fixed relation with respect to a wall adjacent the lower end of a door and a latch assembly which is mounted on the door so that a latch element of the assembly is substantially vertically disposed, the latch element being downwardly biased so that the lower end thereof is received in the track. Accordingly, the track and the latch element cooperate to fix the lower end of the door when the door is in either of the open or closed positions thereof and also to fix the lower end of the door when the door is in various intermediate positions therebetween. The track is formed so that it extends inwardly toward the wall at the opposite ends of the track so that the track and the latch element cooperate to position the door in snug engagement with the wall when it is in either of the open or closed positions thereof. When the door is in an intermediate position between the open and closed positions thereof, the track and latch assembly cooperate to position the door so that the lower end thereof is spaced outwardly slightly from the wall to permit the door to slide freely. Accordingly, when the door is moved from either of its open or closed positions, the lower end of the door is first moved outwardly slightly with respect to the wall and then the door is advanced along the track so that the lower end of the door is maintained in slightly outwardly spaced relation to the wall. In the preferred embodiment of the track and latch assembly of the instant invention, the track comprises an elongated main portion which extends in substantially parallel relation to the lower end of door in outwardly spaced relation to the wall and a pair of track end portions which extend arcuately inwardly from the main portion toward the wall. The track end portions preferably have upwardly facing inner surfaces which are upwardly inclined in directions generally toward the wall, terminating in locking surfaces which generally face the wall. Accordingly, when the door is moved so that it approaches either of the open or closed positions thereof, the latch element is urged upwardly although it nevertheless cooperates with the track to guide the lower end of the door inwardly toward the wall until the door is in snug engagement with the wall. When the door reaches a position of engagement with the wall, the downwardly biased latch element drops past the inner end of the adjacent upwardly inclined surface and passes downwardly along the adjacent locking surface to retain the door in snug engagement with the wall. Further, the track end portions are preferably formed so that the upwardly inclined surfaces and the locking surfaces thereof cooperate to define substantially sharp locking edges at the inner ends of the track end portions, and the latch element is formed with an outwardly facing bevelled surface on the lower portion thereof. As a result, when the door is moved inwardly towards the wall so that the latch element drops past the end of the adjacent inclined surface, the bevelled surface of the latch element engages the adjacent locking edge to provide a camming effect for urging the latch element inwardly and thereby further urging the door into snug engagement with the wall.

Although the track and latch assembly of the instant invention can be used in various types of door assemblies, it has been found to be particularly effective for slidable door assemblies used in vehicles, particularly in interiors of vehicles such as trucks, vans and the like. In this regard, small trucks and vans frequently have interior partitions which separate the cab areas thereof from the load carrying areas thereof. It is frequently desirable to have doorways in these partitions; and frequently, due to limited space accommodations, slidable door assemblies are the only types of door assemblies which are practical for closing these doorways. Since the slidable door assemblies which are used in applications of this type are necessarily mounted in relatively close relation to the cab areas of these vehicles, and therefore close to the driver and passenger areas thereof, the problem of door rattling becomes even more acute. The track and latch assembly of the instant invention provides an effective solution to this problem by providing a means whereby the lower end of an interior slidable door can be maintained substantially rattle-free when it is in either of the open or closed positions thereof.

Accordingly, it is a primary object of the instant invention to provide a track and latch assembly for a slidable door which is operative for firming securing the door when it is in either of the open or closed positions thereof.

Another object of the instant invention is to provide a track and latch assembly which is operable for guiding and positioning the lower end of a slidable interior door of a vehicle so that the door is maintained substantially rattle free when it is in either of the open or closed positions thereof.

Another object of the instant invention is to provide a track and latch assembly for a slidable door which is operative for positioning the lower end of the door so that it is in snug engagement with an adjacent wall when the door is in either of the open or closed positions thereof but so that the lower end of the door is spaced outwardly from the wall when it is in an intermediate position between the open and closed positions thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figures 1, 4:
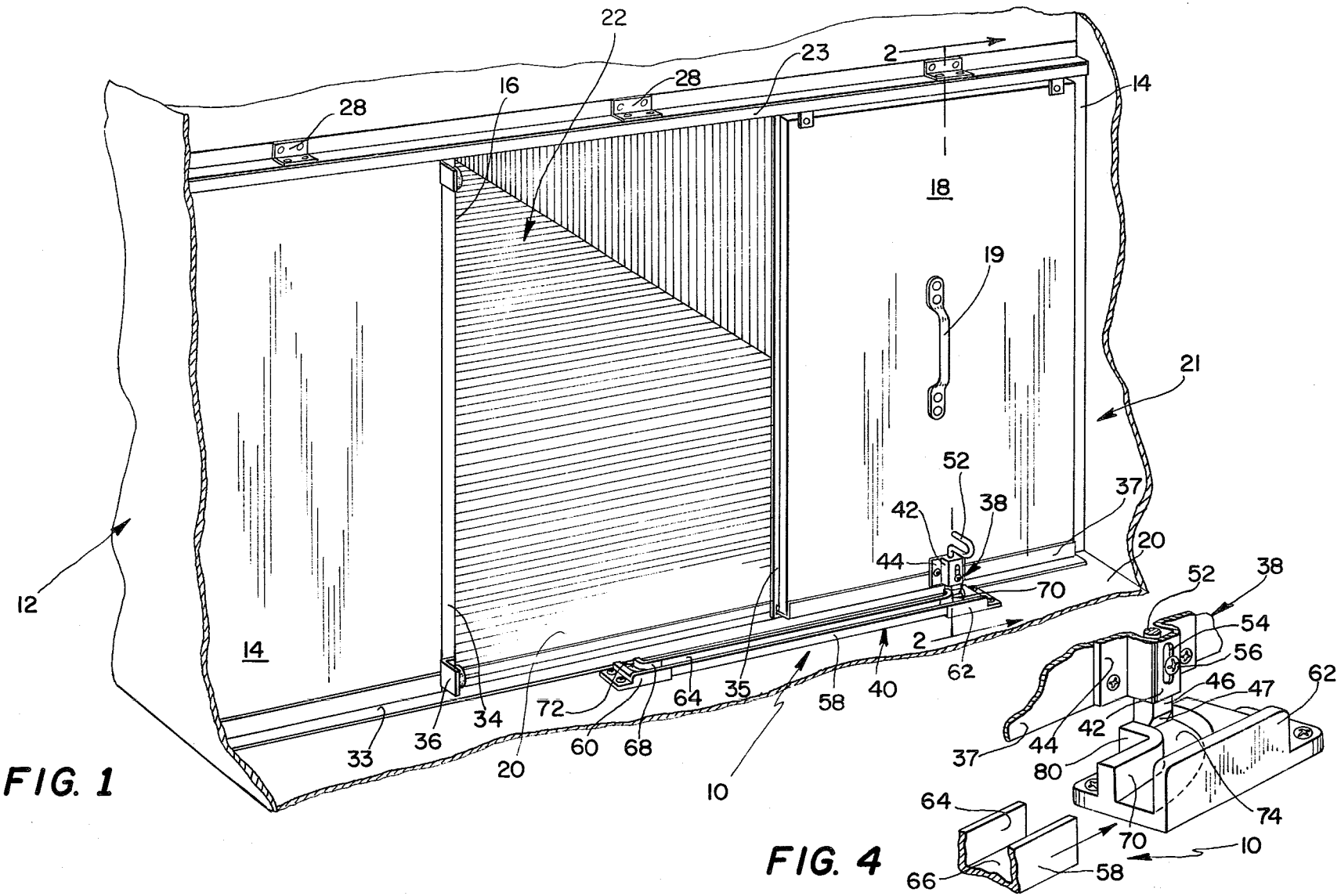
FIG. 1 is perspective view of the track and latch assembly of the instant invention mounted adjacent an interior partition of a truck for guiding and positioning the lower end of a slidable door which is mounted adjacent a door opening in the partition.
FIG. 4 is an enlarged fragmentary perspective view of the track and latch assembly.
Figure 2:
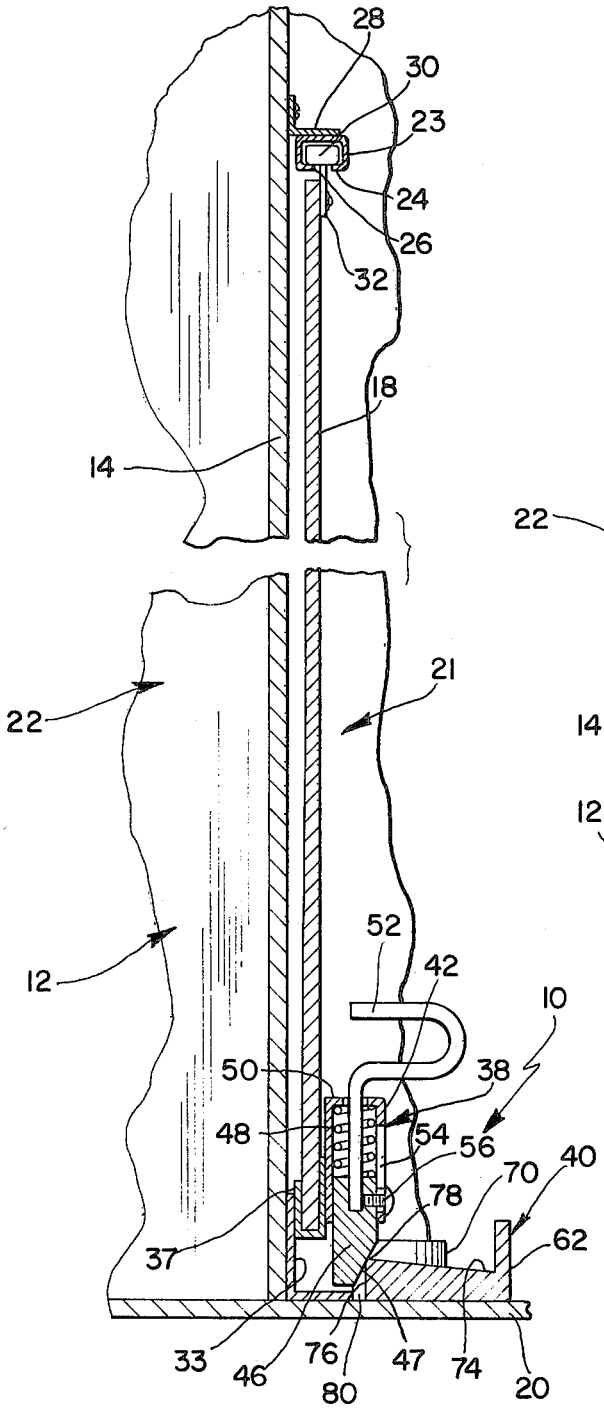
FIG. 2 is a fragmentary sectional view taken along line 2—2 in FIG. 1.

Referring now to the drawing, the track and latch assembly of the instant invention is illustrated and generally indicated at 10 in FIGS. 1–4. The track and latch assembly 10 is mounted in the interior of a truck generally indicated at 12 adjacent a partition or wall 14 having a door opening 16 therein, the truck 12 also including a slidable door panel 18 having a handle 19 mounted adjacent the wall 14, and a floor 20 which extends both forwardly and rearwardly from the wall 14. The track and latch assembly 10 is mounted on the floor 20 in front of the wall 14 and connected to the door panel 18 for positioning the lower end thereof relative to the wall 14. Specifically, the track and latch assembly 10 is operative for positioning the door panel 18 so that when it is in either of the open or closed positions thereof it is in snug engagement with the wall 14 adjacent the lower end of the panel 18 and so that when the door panel 18 is in any of the various intermediate positions between the open and closed positions thereof the lower end of the panel 18 is spaced outwardly from the wall 14. Accordingly, when the door panel 18 is in either of the open or closed positions thereof, it is securely held so that it remains substantially rattle-free during movement of the truck 12; but the panel 18 is nevertheless freely slidable between the open and closed positions thereof.

Figure 3:
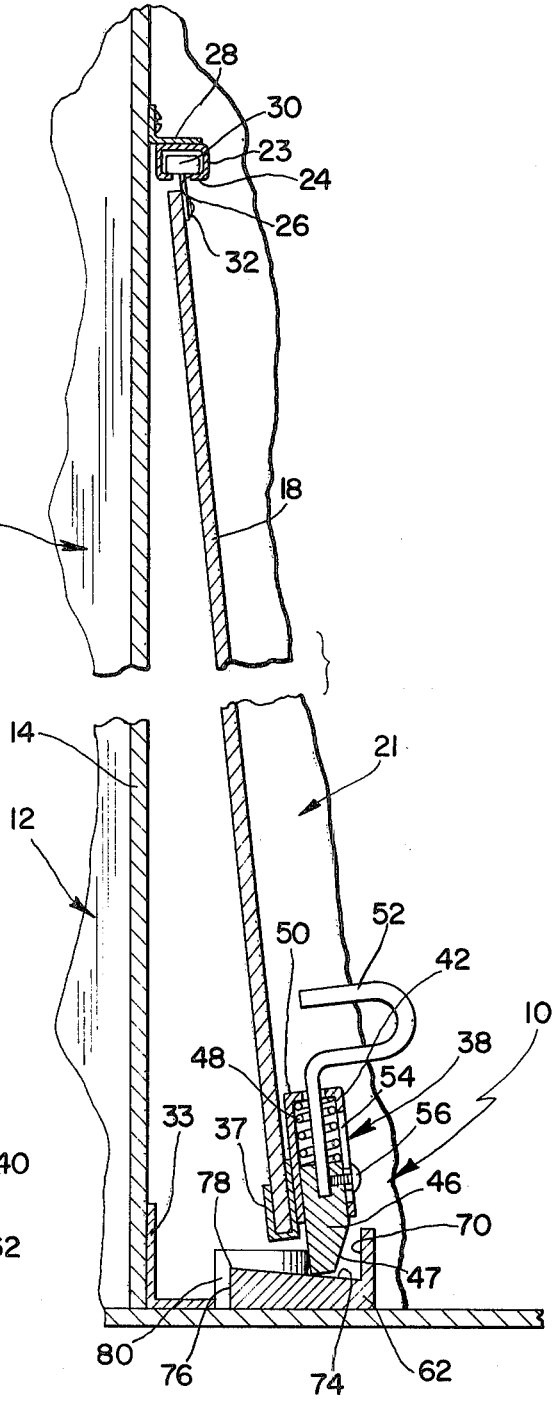
FIG. 3 is a similar sectional view with the slidable door in an intermediate position which is adjacent to the open position thereof.

The truck 12 is a conventional truck, such as a van or the like, and the wall 14 which includes the opening 16 provides a partition between a cab area generally indicated at 21 of the truck 12 and a load carrying area generally indicated at 22 thereof. The door panel 18 preferably comprises a substantially rigid rectangular panel, and it is slidably suspended adjacent the upper end thereof from a trackway 23 which is mounted adjacent the upper end of the wall 14 in a substantially horizontal disposition. The trackway 23 comprises a downwardly facing elongated channel member having opposed inwardly extending flanges 24 on the lower side thereof which cooperate to define an elongated slot 26 of reduced width. The trackway 23 is mounted on the wall 14 with angle brackets 28, and the door panel 18 is slidably suspended from the trackway 23 with a pair of slides 30 which are loosely received therein so that they rest on the flanges 24, the slides 30 having downwardly extending tabs 32 which are secured to the door panel 18 adjacent the upper end thereof. Accordingly, the trackway 23 and the slides 30 cooperate to slidably mount the door 18 so that it is slidable between an open position, wherein the opening 16 is substantially unobstructed, and a closed position, wherein the opening 16 is substantially obstructed. Further, because of the manner in which the door panel 18 is suspended at the upper end thereof from the trackway 23, the door panel 18 is outwardly pivotable slightly to permit the lower end thereof to be moved outwardly slightly with respect to the wall 14 as illustrated in FIG. 3. Also included in the truck 12 at the lower end of the wall 14 on the forwardly facing side thereof is an elongated angle member 33 which is attached to the floor 20. The angle member 33 defines the lower periphery of the opening 16, and a pair of vertical frame elements 34 and 35 which are also mounted on the forwardly facing side of the wall 14 define the sides of the opening 16, the upper extremity of the opening 16 being defined by a similar frame element (not shown) which is positioned behind the upper trackway 23. A pair of cushioned door stops 36 are mounted on the frame element 34 for preventing movement of the door panel 18 beyond the closed position thereof. The lower end of the door panel 18 is defined by an elongated channel element 37.

The track and latch assembly 10 comprises a latch assembly generally indicated at 38, which is mounted on the forwardly facing side of the door 18 adjacent the lower end thereof, and a track assembly generally indicated at 40 which is mounted on the floor 20 adjacent the lower end of the door 18 so that it is spaced outwardly with respect to the wall 14. The latch assembly 38 comprises a housing 42 which is integrally formed with a pair of outwardly extending mounting brackets 44 for securing the latch assembly 38 to the door panel 18. The latch assembly 38 further comprises a latch element 46 which is slidably received in the lower portion of the housing 42, and has a bevelled surface 47 adjacent the lower end thereof which faces generally outwardly with respect to the wall 14, and a coil spring 48 is positioned in the upper portion of the housing 42 for downwardly biasing the latch element 46. The spring 48 is retained at the upper end thereof by an upper wall 50 of the housing 42, and a handle element 52 which is attached to the latch element 46 extends through the spring 48 and the upper wall 50 for manually moving the latch element 46 upwardly within the housing 42. An elongated substantially vertical slot 54 is provided on the front of the housing 42, and a screw 56 which is attached to the latch element 46 extends through the slot 54 so that it travels therein for guiding and limiting the travel of the latch element 46 in the housing 42. The latch assembly 38 is mounted on the lower channel frame element 37 in the central portion of the door 18 so that the latch element 46 travels in a generally vertical disposition.

The track assembly 40 comprises an elongated main track portion 58 and a pair of track end portions 60 and 62 which are positioned so that they extend from the opposite ends of the main portion 58. The main track portion 58 is mounted on the floor 20 in outwardly spaced relation to the wall 14, and it defines an upwardly facing channel 64 having an upwardly facing inner track surface 66 which is illustrated in FIG. 4. The track end portions 60 and 62 are also mounted on the floor 20 and are formed to define channels 68 and 70, respectively, which extend arcuately inwardly toward the wall 14 from the channel 64. The track end portions 60 and 62 are further formed with upwardly facing inner track surfaces 72 and 74, respectively, which are upwardly inclined in the inward extents thereof toward the wall 14. The upwardly inclined surfaces 72 and 74 terminate in spaced relation to the wall 14 and downwardly extending locking surfaces 76 which face generally toward the wall 14 are formed adjacent the inner ends of the inclined surfaces 72 and 74, the locking surfaces 76 preferably intersecting with the inclined surfaces 72 and 74 to define locking edges 78 on the end portions 60 and 62. Also formed in the end portions 60 and 62 are spaced retainer arms 80 which extend integrally inwardly from the respective channel walls and cooperate with the respective locking surfaces 76 to define substantially vertical slots for receiving the latch element 46 in a manner which will hereinafter be more fully described.

The latch assembly 38 and the track assembly 40 are mounted on the truck 12 so that they cooperate for positioning the door 18 so that it is in snug engagement with the wall 14 adjacent the lower end of the door 18 when the door 18 is in either of the open or closed positions thereof and so that the lower end of the door 18 is spaced outwardly slightly with respect to the wall 14 when the door 18 is in an intermediate position between the open and closed positions thereof. More specifically, the latch assembly 38 is mounted on the door 18 adjacent the lower end thereof, and the latch element 42 is received in the track assembly 40. When the door 18 is moved from an intermediate position, wherein the door 18 partially obstructs the opening 16, to an open position wherein the opening 16 is substantially unobstructed, the lower end of the door 18 travels in substantially parallel relation to the wall 14, and is guided by the latch element 42 which travels in the track main portion 58. As the door 18 approaches the open position thereof, the latch element 42 is received in the channel 70 of the track end portion 62 and the latch element 46 is urged upwardly in the housing 42 as it rides over the inclined upwardly facing surface 74. As the latch element 46 travels in the channel 70, the door 18 is moved inwardly toward the wall 14 until it is in a position of snug engagement therewith or, more specifically, until the channel member 37 is in snug engagement with the angle member 33. When the door 18 reaches this position, the latch element 46 falls past the inner end of the inclined surface 74 so that it passes downwardly along the locking surface 76 into the slot defined by the arms 80, until the bevelled surface 47 engages the locking edge 78. As a result of the spring 48 which downwardly biases the latch element 46, a camming effect is achieved between the bevelled surface 47 and the locking edge 78 which tends to further urge the lower end of the door 18 inwardly so that the channel member 37 engages the angle member 33 in the manner illustrated in FIG. 2. The retainer arms 80 of the end portion 62 prevent further lateral movement of the door 18 once it is in the open position by containing the latch element 46. In order to thereafter move the door 18 to the closed position thereof, the handle 52 must be manually moved upwardly so that the latch element 46 is moved upwardly in the housing 50 to permit it to pass by the locking edge 78, and the door 18 is then manually urged outwardly. After the latch element 46 has been moved into the channel 70, the door 18 may be slidably moved toward the closed position thereof, and when the latch element 46 is received in the end portion 60, the lower end of the door 18 is urged inwardly until the latch element 46 falls past the locking edge 78 of the end portion 60 to lock the door 18 in the closed position thereof, wherein it is in snug engagement with the wall 14 adjacent the lower end of the door 18. When the door 18 is in this position, the stops 36 cooperate with the track and latch assembly 10 to prevent further sliding movement of the door 18 beyond the closed position thereof, although the retainer arms 80 on the end portion 60 are also provided for this purpose.

It it seen therefore that the track and latch assembly 10 provides an effective means for positioning the slidable door 18 so that it is in snug engagement with the wall 14 when it is in either of the open or closed positions thereof, and for guiding the door 18 between the open and closed positions thereof. As a result of the unique constructions of the latch assembly 38 and the track assembly 40, when the door 18 approaches the end of its travel toward either of the open or closed positions thereof, it is automatically urged into engagement with the wall 14 and locked in a position wherein it is maintained substantially rattle-free during subsequent movement of the truck 12. Accordingly, for these reasons as well as the other reasons hereinabove set forth, it is seen that the track and latch assembly 10 of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A track and latch assembly for a slidable door, wherein the door is slidably supported adjacent a wall so that it is movable between an open position, wherein an opening in the wall is substantially unobstructed by the door, and a closed position wherein the opening is substantially obstructed by the door, the door being at least slightly pivotable about an axis adjacent the upper end thereof for movement of the lower end of the door outwardly slightly with respect to the wall, said track and lock assembly comprising:

(a) latch means mounted on said door adjacent the lower end thereof; and (b) track means mounted in a fixed position with respect to said wall adjacent the lower end of said door, said latch means being received in said track means and cooperating therewith to guide and position said door so that when it is in one of said open or closed positions thereof, it is in snug engagement with said wall adjacent the lower end of said door but so that during movement of said door between said open and closed positions thereof, the portion of said door adjacent the lower end thereof is spaced outwardly from said wall.

2. In the track and latch assembly of claim 1, said track means cooperating to position said door so that it is in snug engagement with said wall when it is in either of said open or closed positions thereof.

3. In the track and latch assembly of claim 2, said latch means comprising:

(a) a latch element; and (b) means mounting said latch element on said door so that it is vertically movable and so that it is downwardly biased and received in said track means.

4. In the track and latch assembly of claim 2, said track means comprising:

(a) an elongated substantially straight main track portion mounted in substantially parallel spaced relation to said wall adjacent the lower end of said door; and (b) first and second track end portions, said first track end portion extending from one end of said track main portion toward said wall and cooperating with said latch means to position said door in the open position thereof, said second track end portion extending from the other end of said main track portion toward said wall and cooperating with said latch means to position said door in the closed position thereof.

5. In the track and latch assembly of claim 4, said first and second track end portions having upwardly facing inner surfaces which are upwardly inclined in directions generally toward said wall terminating in locking surfaces which face generally toward said wall, said latch element traveling over the respective inner surface during movement of said door to either of the open or closed positions thereof and passing downwardly adjacent the respective locking surface to retain said door in engagement with said wall.

6. In the track and latch assembly of claim 5, said locking surfaces intersecting with the respective inner surfaces to define locking edges of the respective track end portions, said latch element having a bevelled surface thereon which faces generally outwardly with respect to said door and downwardly, the respective locking edge camming against said bevelled surface to urge said door into snug engagement with said wall adjacent the lower end of said door when said door is in either of said open or closed positions thereof.

7. In the track and latch assembly of claim 5, each of said track end portions having a pair of spaced retainer arms which extend inwardly toward said wall and cooperate with the respective locking surface to define a substantially vertical slot, said latch element being received in the respective slot when said door is in either of the open or closed positions thereof, whereby said latch element cooperates with the respective retainer arms to prevent sliding movement of said door.

8. In the track and latch assembly of claim 5, said track main portion having an inner track surface, said latch element traveling over said main portion inner track surface when said latch element is positioned in said track main portion, said upwardly inclined inner surfaces extending from said track main portion inner surface.

9. In the track and latch assembly of claim 8, said track end portions extending arcuately toward said wall.

* * * * *